US010548405B2

(12) United States Patent
Komsky et al.

(10) Patent No.: US 10,548,405 B2
(45) Date of Patent: Feb. 4, 2020

(54) TRAVEL PILLOW WITH ADDITIONAL CHIN SUPPORT

(71) Applicants: Irene Komsky, Danville, CA (US); Henry Komsky, Danville, CA (US)

(72) Inventors: Irene Komsky, Danville, CA (US); Henry Komsky, Danville, CA (US)

( * ) Notice: Subject to any disclaimer, the term of this patent is extended or adjusted under 35 U.S.C. 154(b) by 0 days.

(21) Appl. No.: 16/296,215

(22) Filed: Mar. 8, 2019

(65) Prior Publication Data

US 2019/0200773 A1 Jul. 4, 2019

Related U.S. Application Data

(63) Continuation-in-part of application No. 15/451,327, filed on Mar. 6, 2017, now abandoned.

(60) Provisional application No. 62/304,302, filed on Mar. 6, 2016.

(51) Int. Cl.

| | |
|---|---|
| ***A47C 16/00*** | (2006.01) |
| ***A47G 9/10*** | (2006.01) |
| ***A47C 7/38*** | (2006.01) |

(52) U.S. Cl.

CPC ..... *A47C 16/00* (2013.01); *A47C 7/383* (2013.01); *A47G 9/1081* (2013.01); *A47G 2009/1018* (2013.01)

(58) Field of Classification Search

CPC ..... A47C 7/383; A47G 2009/1018; A61G 13/121

See application file for complete search history.

(56) References Cited

U.S. PATENT DOCUMENTS

| | | | | |
|---|---|---|---|---|
| 4,617,691 | A * | 10/1986 | Monti | A47C 7/383 128/DIG. 23 |
| 6,058,517 | A * | 5/2000 | Hartunian | A41D 13/0512 2/468 |
| 6,219,865 | B1 * | 4/2001 | Stokesbary | A47G 9/10 297/392 |
| D469,541 | S * | 1/2003 | Cheatham | D24/191 |
| 6,641,221 | B1 * | 11/2003 | Kastlunger | A47C 7/383 297/392 |
| D582,045 | S * | 12/2008 | James | D24/191 |
| D715,581 | S * | 10/2014 | Kawamura | D6/601 |
| D790,880 | S * | 7/2017 | Wong | D6/601 |
| 2002/0156408 | A1 * | 10/2002 | Cheatham | A61F 5/055 602/13 |
| 2013/0283534 | A1 * | 10/2013 | Marinkovic | A47G 9/109 5/636 |
| 2017/0000273 | A1 * | 1/2017 | Mitchell | A47C 7/383 |

* cited by examiner

*Primary Examiner* — Eric J Kurilla
(74) *Attorney, Agent, or Firm* — Schlackman IP Law; Steven Schlackman; Diana Mederos

(57) ABSTRACT

A travel pillow with a chin extension for additional support to keep a user's head from falling forwarded while sitting in an upright or reclining position in a high-backed chair, such as those on an airplane, train, automobile, or bus. The travel pillow comprises a parabolic U-shaped cushion, with sides that minimize lateral head movement, a forward chin extension adds extra support for the chin and head, an extension on each of the rear end of the side panels that curve around the rear shoulders, and a means of fastening the open side panels together behind the neck to ensure that the pillow cannot fall forward, away from the user.

9 Claims, 8 Drawing Sheets

TRAVEL PILLOW WITH ADDITIONAL CHIN SUPPORT

PRIORITY CLAIM

This application is a continuation-in-part of U.S. non-provisional application Ser. No. 15/451,327, filed Mar. 6, 2017, which claims the benefit of U.S. Provisional Patent Application Ser. No. 62/304,302, filed on Mar. 6, 2016, the entire contents of which are incorporated herein by this reference.

FIELD OF THE DISCLOSURE

The present invention is a travel pillow with a chin extension for additional support to keep a user's head from falling forwarded while sitting in an upright or reclining position in a high-backed chair, such as those on an airplane, train, automobile, or bus. The travel pillow preferably is parabolic or U-shaped and positioned around a user's neck.

BACKGROUND

Air travel is becoming increasingly ubiquitous and accessible due to the availability of low cost flights and increased air routes being served by airlines across the globe.

The U.S. Department of Transportation's Bureau of Transportation Statistics (BTS) reported in 2014, that U.S. airlines and foreign airlines serving the United States carried an all-time high of 848.1 million system-wide (domestic and international) scheduled service passengers, which was 2.5 percent more than in 2013 and 1.2 percent more than the previous record-high of 838.4 million reached in 2007.

Internationally, commercial passenger airlines logged 50.9 million flight hours with nearly twenty-four million departures and over 2.8 billion passengers fly for an average of over 2 hours per departure. At any given moment, there are approximately 690,000 passengers in the air. The trend is only increasing. Global air passenger traffic grew by 6.5% in 2015 as a whole, well above the 10-year average annual growth of 5.5%.

Unfortunately, air travel also comes with increasing health concerns, particularly, regarding back and neck pain associated with airline seating. While seat comfort is a subjective issue, the effect that poorly designed airline seats have on posture is undeniable.

It is well known by those in the industry that undue stress is placed on the human body when subjected to static positioning over long periods of time. People complain about neck pain only second to headaches. Neck pain is most likely due to poor posture. Multiple studies suggest that a substantial number of people experience increased neck pain following a flight. For frequent travelers, or those who have prior neck issues may find that putting their posture under pressure may result in a higher risk of long-term neck problems.

A major factor in travel-related neck discomfort is the seats themselves. The majority of coach seats have no adjustments for lumbar support. As well, the tops of the seats push the head forward, forcing the body into an awkward posture and causing strain on the neck muscles.

Neck problems are particularly acute for those passengers attempting to sleep on flights. Without head and neck support, passengers find themselves lolling to the side or falling forward, putting additional acute strain on the neck and upper vertebrae. However, this acute strain can result in gradual and long-term effects on posture.

For those few airlines that have seats with some type of headrest mechanism, they rarely support the head to the extent necessary to avoid neck strain. Experts suggest that passengers move around the cabin, but that is not always possible due to air conditions such as turbulence or during service times by airline flight attendants. Passengers in center seats have additional concerns due to the inability to lean to the side as can be done in window seats or being able to stretch their legs as with aisle seats. Many international flights have a 5-seat center configuration where middle seat passengers have additional difficulties leaving their seats.

It is suggested that sitting at a 135 degree angle places the least pressure on the vertebral discs and associated structures; however, that level of recline is rarely available on current coach airplanes, although some first-class cabins, particularly trans-continental flights, include seats that recline for sleeping.

To alleviate neck pain, passengers have turned to various neck pillows, which claim to add additional head support alleviating pain and discomfort while traveling. However, the travel pillows currently on the market are missing important functional components and have problems such as having a poor fit that allows too much head movement or not allowing enough head and neck movement, being made form materials that don't have enough strength to support the head, and none include a means of sufficiently supporting the head from falling forward.

For example, the following represent travel pillows on the market today.

The Kuh i Comfort Travel Pillow is made of two soft cylindrical balls, attached by a strap. According to company literature, the advantage of this pillow is that it can be used in multiple ways. In one position, it can be used behind a person's neck or head. A person can straighten the strap and the person can tuck one end over the shoulder for side support, or the pillow can be placed behind the back for lumbar support. Unfortunately, the lack of stiffness across the entire device provides inefficient support, particularly when it comes to forward head support.

The Cab eau Evolution Pillow is a modified version of the traditional ring pillow. It's made of memory foam and has raised side supports to cradle your neck or can be worn backwards to support your chin. However, it does not support the head all around, including the chin, allowing for too much head and neck movement and not enough support. There is also too much space between the chest and the device, and the device allows the head to fall forward to a point where the unit puts pressure on the neck, making it hard to breathe.

The Travelrest Travel Pillow is shaped like a banana and is about the length of a person's head to waist. It is meant to be a side resting pillow. It is larger on the top, to rest your head, and then tapers into a slight curve that is placed across the body, similar to a sling. A long string at the bottom lets a person attach the two ends to secure the pillow around the passenger's waist or to the airplane seat. The pillow, while generally supportive, only supports one side of the head. For those that wish to switch positions, they must untie and readjust the pillow. As well, the device has no chin support, making it difficult to use on airline seats with minimal recline. Furthermore, this pillow is not compact enough to easily stow and carry when traveling.

The generic inflatable neck pillow is one of the most popular and easy-to-find travel pillows on the market. These pillows are shaped like a horseshoe, draped around the neck and tied in the front. The inflatable air pillow relies on air pressure for support. However, the air pressure is often variable, depending upon the aircraft flying altitude. When the aircraft flies in the higher altitude, the air pillow will expand and it will contract in the lower altitude. The change in pressure can be problematic and disturbing to aircraft passengers when the flying altitude changes. As well, one of the main drawbacks of an inflatable pillow is that the air moves in the opposite direction as a result of the pressure applied by someone's head, leaving an uneven pressure gradient throughout the inflatable pillow. Most of the inflatable air pillows are made from vinyl material that will cause the user to feel hot and sticky. These traditional pillows are not breathable and can result in the person breaking out with acne on the chest, neck, and chin. However, the advantage of the inflatable pillow is the ease of storage and its light weight.

SUMMARY

What is needed is a travel pillow that provides enough support for the head and neck, preferably maintaining the head and neck at substantially within 40 degrees of a 90-degree upright baseline, provides support against a user's chest, is easy to adjust to a custom fit, easy to stow and carry, resistant to changes in cabin temperature and pressure, and is breathable.

A parabolic travel pillow comprises a pillow body exterior having an upper portion, a lower portion, a rear portion, a front portion, at least two side panels, an apex, at least one rear portion fastener, a chin extension, and a rear extension, and wherein the pillow is used to support a user's head and neck during travel when sitting in an upright or reclined position.

In an additional embodiment, a parabolic travel pillow comprises a pillow body exterior having an upper portion, a lower portion, a rear portion, a front portion, at least two side panels, an apex, at least one rear portion fastener capable of being adjusted, a chin extension, a rear extension, and wherein the pillow body exterior is enclosed in a casing having interior space, fill, and at least one casing fastener, and wherein the pillow is used to support a user's head and neck during travel when sifting in an upright or reclined position.

In an additional embodiment, a pillow comprises bilateral cores from an apex center, core contours, and a contoured parabola on either side of the chin extension.

A method of providing head and neck support is also disclosed. The method comprises the steps of placing a parabolic travel pillow around a user's neck, upon a user's shoulders, and beneath a user's chin, where the pillow comprising a pillow body exterior having an upper portion, a lower portion, a rear portion, a front portion, at least two side panels, an apex, at least one rear portion fastener, a chin extension, and a rear extension; attaching the at least one rear fastener behind the user's neck; and adjusting the at least one fastener to fit the pillow firmly in place so that the pillow abuts the user's chin, neck, shoulders, and chest.

REFERENCE NUMERALS OF THE FIGURES

Figure 1A:
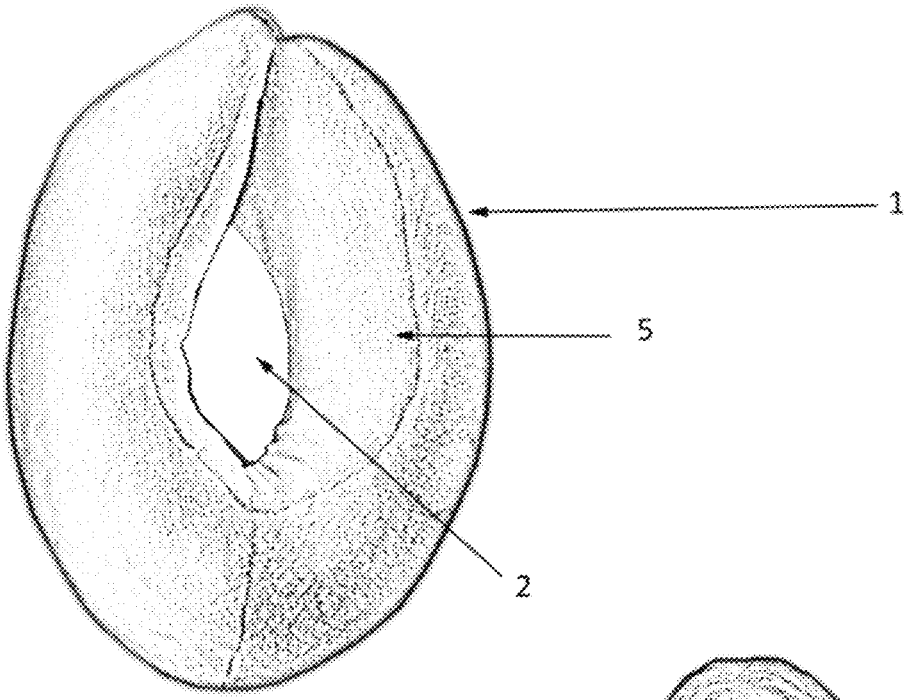
FIG. 1A illustrates a top view of an exemplary pillow as worn by a user.

The following list refers to the figures:

1. Parabolic travel pillow
2. Neck
3. Chest
5. Pillow body exterior
10. High-profile side panel
12. Rear extension
15. Chin extension
20. Apex
25. Rear portion fastener
30. Upper portion
35. Lower portion
40. Open end
45. Rear portion
50. Front portion
55. Casing
60. Interior space
65. Casing fastener
70. Fill
75. Core
80. Alternative panel
85. Level side panel
90. Core contour
95. Inside surface
100. Outside surface
105. Apex center
110. Side panel crest
115. Contoured parabola

DETAILED DESCRIPTION

The present disclosure provides generally for a travel pillow with a chin extension for additional support to keep a user's head from falling forward while the user is sitting in an upright or reclining position in a high-backed chair, such as those on an airplane, train, automobile, or bus.

The travel pillow comprises a parabolic or U-shaped cushion and may comprise high-profile sides that minimize lateral head movement, a forward chin extension adds extra support for the chin and head, an extension on each of the rear end of the side panels that curves around the rear shoulders, and at least one fastener to secure the open side panels together in front or behind the neck to ensure that the pillow cannot fall forward or slide backward away from the user. The fasteners can also be used to compact the pillow into a travel size.

The travel pillow's parabolic U-shape is designed to fit around the neck of the user, wherein the open part of the "U" or parabola is preferably located at the back of the user's neck. The pillow fits snugly around the user's neck to sufficiently hold the head in position. The sides of the U-shaped pillow are high-profile panels which are supported by the user's shoulders. The high profile panels minimize lateral tilting of the head.

The pillow contours to a lower profile at the forward apex of the U-shape, wherein the apex fits under the user's chin; the upper portion of the apex being in contact with the chin and the lower portion of the apex extending downward, coming into contact with the upper portion of the user's chest. The chin extension acts as a brace, preventing the chin from falling forward towards the user's chest.

At the rear end of the pillow, wherein the side panels form the open-end of the U-shape at the back of the neck area, is a fastener or means of fastening the two side panels together such that fasteners enclose the sides of the pillow around the user's neck, preventing the pillow from falling forward or sliding backward off of the user. The lower end of each side panel has rear extensions that curve rearward and downward, behind the user's shoulders, which provides additional support and helps keep the pillow in place when the side panels are not fastened together.

In some embodiments, the body of the travel pillow comprises an outside casing, which may be stuffed with an interior fill. The material of the casing is typically constructed of a washable, woven or knitted fabric, including synthetic or natural fibers, such as cottons, polyesters, fleeces, wools, or flannels, or a combination thereof.

In some embodiments, the body of the travel pillow comprises a single piece of injection-molded foam or multiple pieces of injection-molded foam fused together. In such embodiments, the travel pillow may be outfitted with a removably or fixedly attached covering or casing.

In some embodiments, the interior space of the pillow body is a single continuous interior compartment which contains the fall material. The fill material can be any of a variety of fibrous, matrix-like, feather, foam, or beaded materials known by the ordinary skilled artisan for stuffing a pillow. The pillow is preferably constructed with a polyurethane foam that provides sufficient support for the passenger's neck and head. However, any fill material capable of providing support for the head and neck is contemplated. The fill material can be of the same density throughout the interior with the exception of the apex area and chin extension which may include a stiffer material to help ensure that the head is kept upright, away from the chest, even when sitting in a slightly forward leaning position.

Additionally, one embodiment uses a combination of air and foam. The foam helps alleviate some of the drawbacks when using air alone, yet allows for a smaller overall volume when deflated making it easier to transport when not in use. The casing can enclose the fill material in a variety of ways including the casing being sewn into place. However, a preferred embodiment allows the casing to be separated from the fill material by a casing fastener well-known in the art, such as a zipper closure, buttons or snaps, hook-and-loop fasteners, or laces.

In an additional embodiment, the fasteners used to connect the two sides of the U-shape at the back of the neck area, or front in some embodiments, are straps which can be used as part of a ratchet and lever system that mechanically condenses the pillow into a small area for easy transport when not in use.

In an additional embodiment, a pillow may have a series or plurality of cores in the interior space that may provide shock absorbency, structure, temperature regulation, pressure resistance, customizable fit for different neck lengths, or airflow, or a combination thereof. A user may tilt his/her head down which may cause the cores to compress, allowing a customizable fit with less resistance than the rest of the pillow body that provides adequate support to substantially hold the user's neck in place.

Figure 1B:
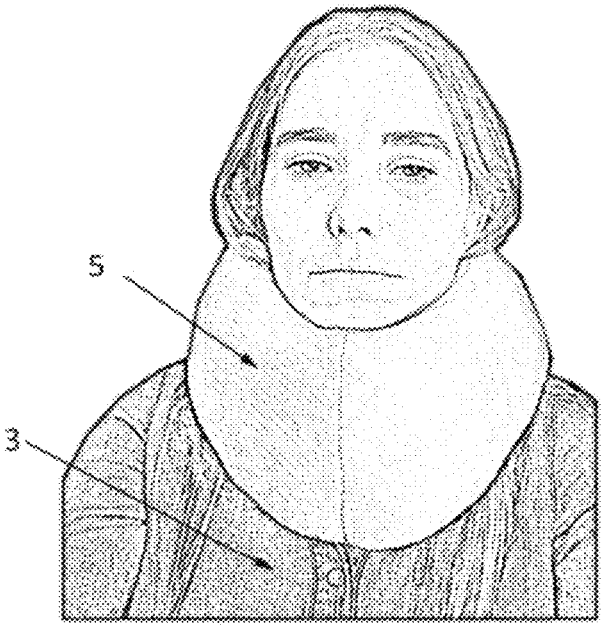
FIG. 1B illustrates a frontal view of an exemplary pillow as worn by a user.

Referring to FIGS. 1A and 1B, a top view of an exemplary pillow and a frontal view of an exemplary pillow as worn by a user are illustrated, respectably. A parabolic travel pillow 1 is positioned around a user's neck 2. The pillow body exterior 5 extends from a user's chest 3 to the user's back and rests upon the user's shoulders. In preferred embodiments, the pillow body exterior 5 abuts the user's neck 2, chest 3, shoulders and trapezius muscles. The fit is snug to where a user can tilt the head while still maintaining the neck at substantially the same angle.

In preferred embodiments, the placement of the parabolic travel pillow 1 substantially maintains the neck 2 at about a 90 angle and head or neck 2 tilt, bend, or rotation in any direction, where the baseline is an upright and straight neck position at 90 degrees. However, the user may adjust the tightness of fit which may further restrict or relax the neck 2 to allow for neck position or head tilt position to be within about 40 degrees of 135 degrees in a rotational or tilt motion of the neck 2 or head. Preferably, the pillow 1 prevents neck 2 flexion beyond about 10 degrees, neck 2 extension beyond about 20 degrees, neck 2 side bending beyond about 5 degrees, and neck 2 rotation beyond about 40 degrees.

Figure 1C:
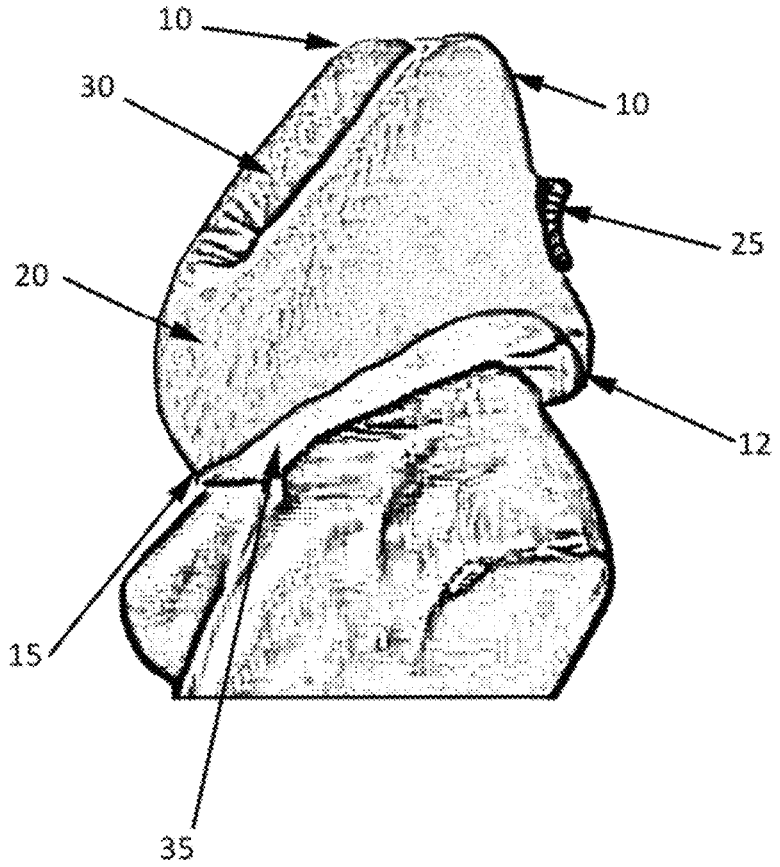
FIG. 1C illustrates a perspective side view of an exemplary pillow as worn by a user.

Referring to FIG. 1C, a perspective side view of an exemplary pillow as worn by a user is illustrated. The structure and position of the pillow 1 provides for head and neck 2 support. Specifically, the pillow 1 has a lower portion 35 that rests on the user's chest 3 and shoulders and an upper portion 30 that fits toward and under the user's neck 2.

Toward the user's back, a rear extension 12 contours and abuts the user's shoulders and extends down and around to the user's trapezius regions. The rear extension 12 may have a pointed, rounded, curved, or tapered shape. The rear extension 12 provides support that encourages upright head and neck 2 placement by reducing neck 2 extension beyond 90 degrees or beyond the recommended maximum angle difference of approximately 40 degrees from the 90 degree baseline in any direction. Preferably, the rear extension 12 does not bulge, allowing for comfortable wear and placement against an upright seat in an airplane, train, or bus or otherwise against a substantially linear or flat surface.

At least one rear portion fastener 25 allows the user to easily adjust the tightness or looseness of fit. There may be one or several rear portion fasteners 25. A fastener 25 may be hook and loop, zipper, buckle, loop, laced, button, snap, adhesive, or elastic, or combinations thereof.

The pillow 1 has an apex 20 and a chin extension 15 that is placed toward the user's chin and chest 3. Preferably, the placement of the pillow 1 is such that the pillow body exterior 5 of the upper portion 30 abuts the user's chin, and the lower portion 35 at the chin extension 15 abuts the user's chest 3. The distance between the upper portion 30 of the apex 20 and the lower portion 35 of the chin extension 15 is from about 10 centimeters to about 16 centimeters. Preferably, there should be approximately a 12- to approximately 13-centimeter length of the pillow body exterior 5 between the upper portion 30 at the apex 20 and the lower portion 35 of the chin extension 15. This configuration supports the user's head and neck 2 and prevents too much or uncomfortable next flexion beyond 80 degrees or beyond the approximate maximum of a 40-degree angle difference from 90 degrees.

The chin extension 15 may have an angled, tapered, rounded, squared, curved, or contoured shape that extends to the chest 3 at approximately the position of the user's sternum at the lower portion 35 and up to the user's chin at the upper portion 30.

On either side of the apex 20 on the pillow body exterior 5, there are side panels that, in some embodiments, are high-profile side panels 10. The high-profile side panels 10 support the head and neck 2 and prevent neck 2 and head side bending of more than approximately 5 degrees. The high-profile side panels 10 may have a flared, tapered, curved, or rounded shape that may extend up toward the user's ears or up to the user's temples. Preferably, the high-profile side panels 10 have a higher profile toward the user's back and a lower profile toward the user's chin so that the pillow body exterior 5 can comfortably and snuggly fit under the chin and on the chest 3. In some embodiments, a pillow 1 may have only one side having a high-profile side panel 10. The high-profile side panels may cradle the user's head and neck 2 by fully or partially wrapping around the back of the user's head to provide comfort, cushion, and support at the user's occipital lobe.

Figure 2A:
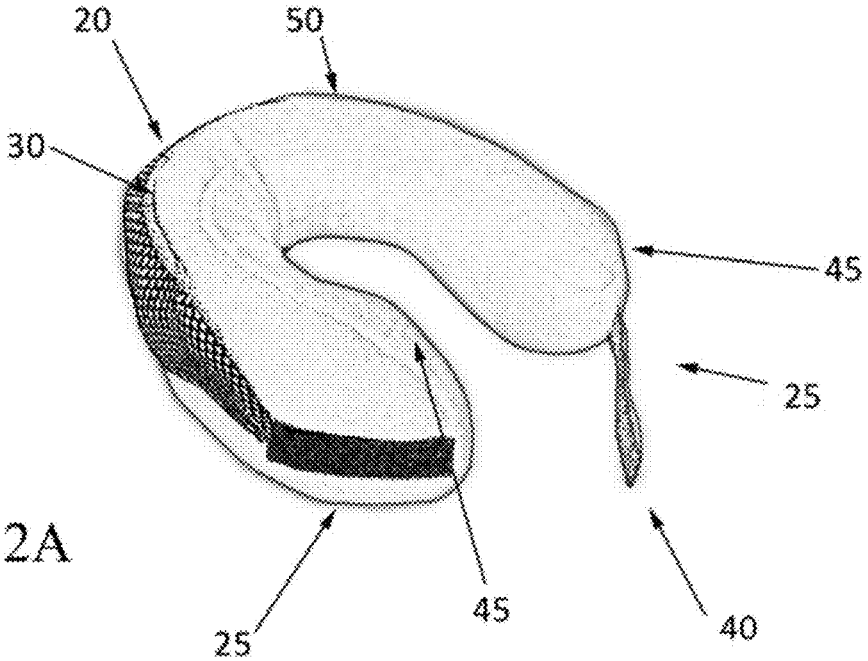
FIG. 2A illustrates a perspective view of the upper portion of an exemplary pillow with a rear portion fastener in the open position.
Figure 2B:
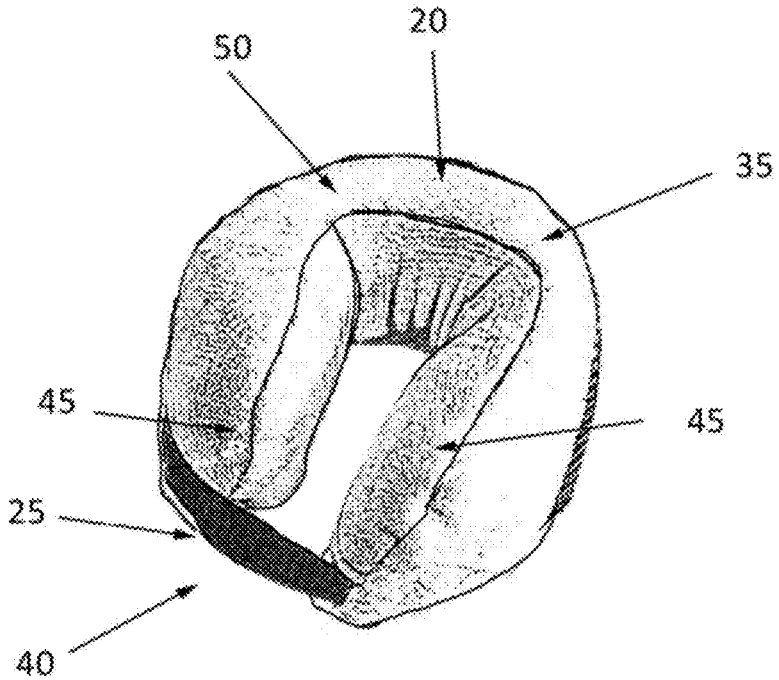
FIG. 2B illustrates a perspective view of the lower portion exemplary pillow with a rear portion fastener in the closed position.

Referring to FIGS. 2A and 2B, perspective views of an exemplary pillow with a rear portion fastener in the open position and a rear portion fastener in the closed position are illustrated, respectably. The apex 20 is opposite from the rear portion fastener 25 at the rear portion 45. The rear portions 45 of the pillow 1 end at an open end 40 of the parabolic shape. The rear portion 45 of each side panel 10 has at least one rear portion fastener 25 that when closed draws the rear portion 45 of each side panel 10 toward a center, in line with the apex 20 but opposite the apex 20 at the open end 40. When the at least one rear portion fastener 25 is released in the open position, the open end 40 is capable of receiving or being released from a user's neck 2. In some embodiments, closing the at least one rear portion fastener 25 improves portability by reducing the volume the pillow 1 occupies by about 15 to about 60 percent.

Figure 3:
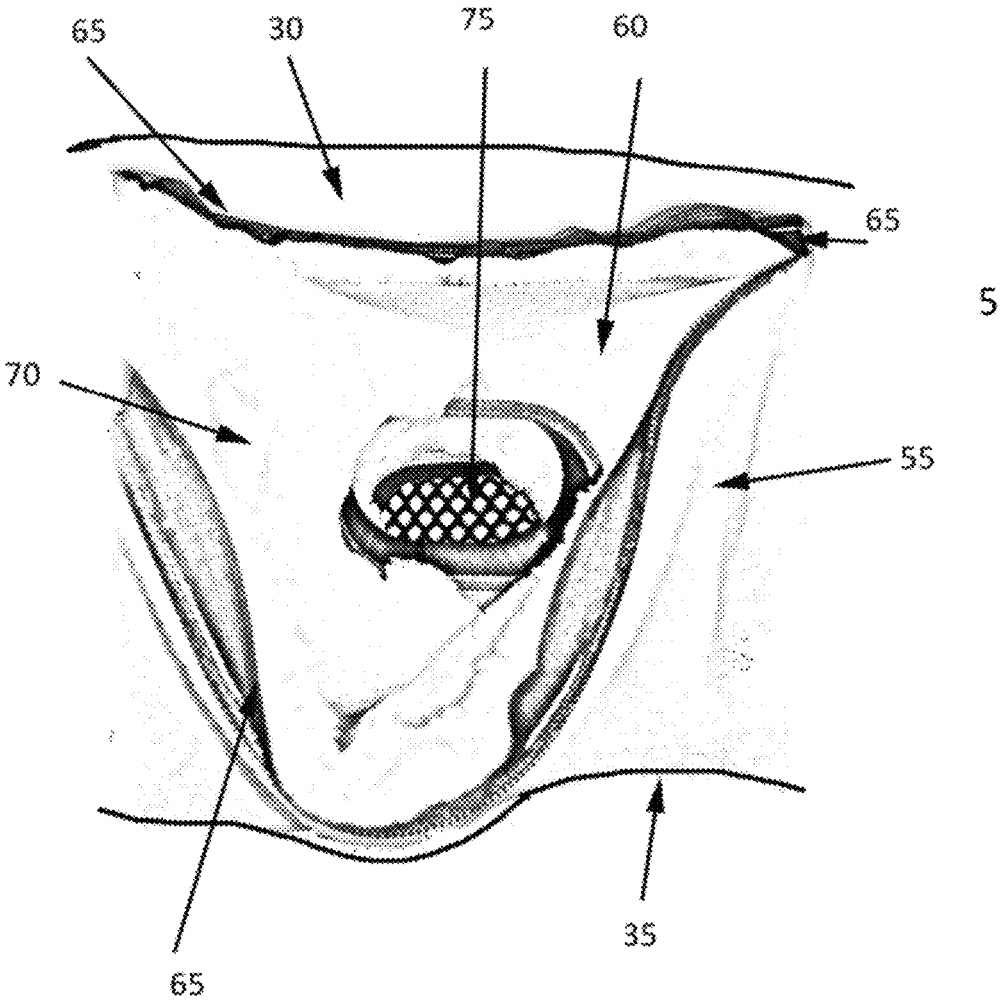
FIG. 3 illustrates a front view of the interior space with fill of an exemplary pillow.

Referring to FIG. 3, a front view of the interior space with fill of an exemplary pillow is illustrated. A casing 55 may enclose a pillow exterior body 5. A casing 55 may be fixably or removably attached. The casing 55 may be removably attached to the pillow exterior body 5 like a sheath or pillow case with at least once casing fastener 65. The casing 55 may be made out of a natural or synthetic fabric such as microfiber, mesh, cotton, polyester, or a combination thereof. Preferably but not exclusively, the casing 55 is made from a breathable material such as cotton with a thread count of 400 to 800. A casing fastener 65 may be any of the same as for a rear portion fastener 25 and may have multiple parts. For example, when the casing fastener 65 is a zipper, the zipper teeth, zipper tape, and zipper pull are ach a casing fastener 65.

The casing 55 may be closed by or open by at least one casing fastener to reveal an interior space 60 capable of receiving the pillow exterior body 5 and fitting in the same parabolic shape as the pillow 1. In some embodiments, the at least one casing fastener 65 joins the lower portion 35 to the upper portion 30 to close the interior space 60.

The interior space 60 on the other hand may be filled with a fill 70 separate or in addition to the pillow exterior body 5. In some embodiments, the fill may replace or substitute the pillow exterior body 5. For example, fill may be foam, fibers, microbeads, gels, or combinations thereof and may have varying density values sufficient for supporting the user's neck and head within the corresponding flexion, extension, and side bending. Memory foam having a density of about 0.5 to about 5 pounds per cubic foot is an acceptable example.

However, the fill 70 memory foam density value may make the pillow heavy and uncomfortable. Therefore, in some embodiments, a pillow 1 may have at least one core 75. A core 75 is preferably hollow or may have an internal matric or other support structure. The core 75 is preferably fixably attached within the pillow body exterior 5. For example, when the pillow body exterior's 5 fill 70 is memory foam, at least one core 75 is placed in a cutout in the pillow body exterior 5. The core may be of varying circumferences, shapes, and sizes so long as the core 75 is substantially fixed to or held in place within the pillow body exterior 5. The core 75 provides structure, breathability, compression resistance, and reduces pillow 1 weight.

Figure 4:
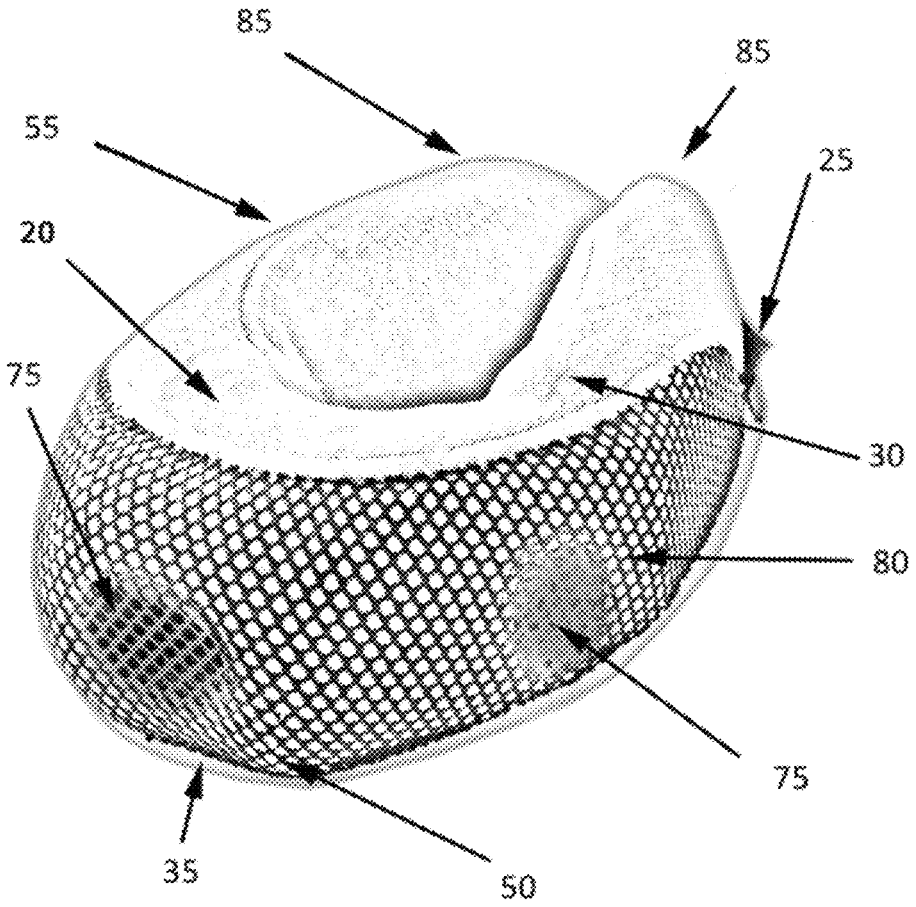
FIG. 4 illustrates a perspective view of the front portion of an exemplary pillow having an alternative panel and visible cores.

Referring to FIG. 4, a perspective view of the front end of an exemplary pillow having an alternative panel and visible cores is illustrated. Cores 75 may be placed at or near the front portion 50, rear portion 45, or side panels 10 or 85. This exemplary embodiment in FIG. 4 shows a pillow 1 having side panels that are level 85. The level side panels 85 each extend from the apex 20 to the rear portion 45 where the at least one rear portion fastener 25 is attached. The casing 55 may be comprised of multiple types of fabric integrated as an alternative panel 80.

An alternative panel may be a wedge or section of a material that contrasts to the material of the casing 55. For example, a casing 55 may be made of microfiber on the lower portion 35, upper portion 30, the open end 40, the chin extension, and the side panels 10 or 85—in other words, the portions of the pillow 1 that come in contact with the user's neck 2, chest 3, and any other body part. The alternative panel 80 preferably is present on or near the apex 20 and the front portion 50 but may also be at the chin extension 15 or the rear extension 12 or combinations thereof. For example, to improve breathability and comfort, the portions of the casing 55, or of the pillow body exterior 5 if there is no additional separate casing 55 that is removably attached, that do not abut the user's skin or body may be made out of a breathable mesh. This improves temperature regulation, prevents excessive sweat, and reduces acne.

Figure 5:
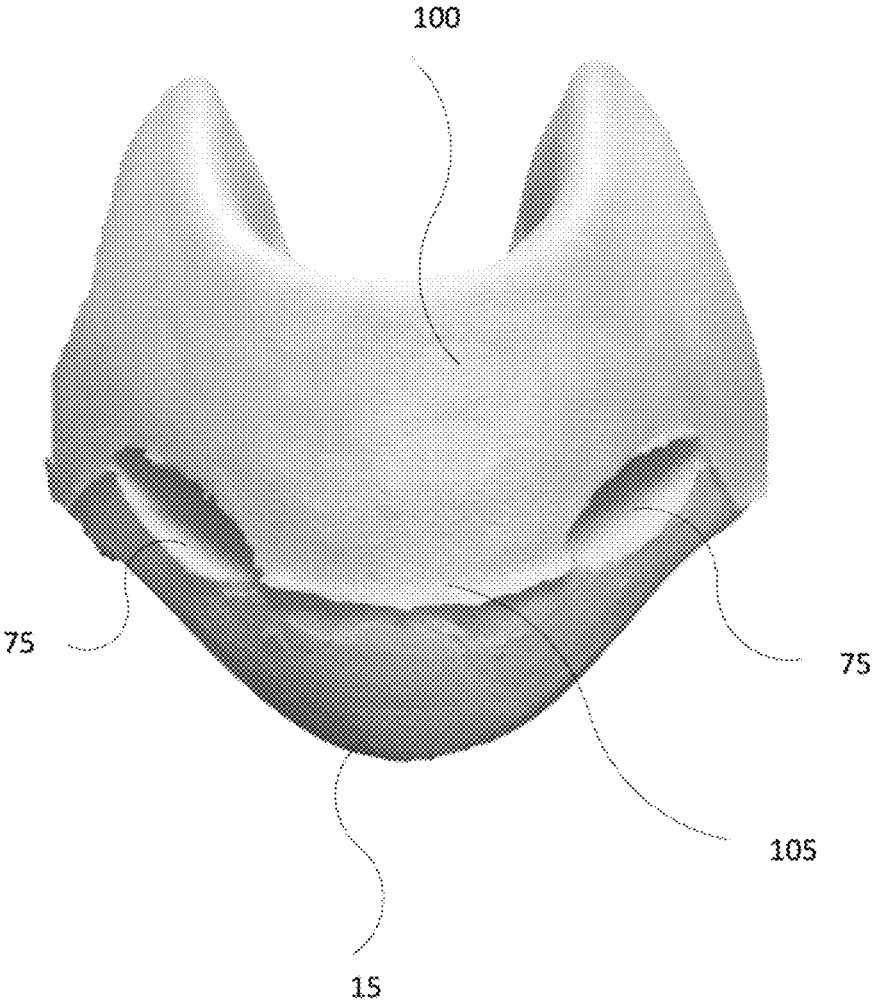
FIG. 5 illustrates a front view of an exemplary embodiment of a pillow.

Referring now to FIG. 5, an alternative exemplary embodiment is shown with a frontal view. The pillow body may comprise injection-molded foam such as closed-cell foam, EVA foam, or other polymer foams such as polyolefin. The pillow may have a covering such as a fitted pillow case that conforms to the shape of the pillow and closes with a zipper or hook-and-loop closure, adhesive, seam, or button closure. This exemplary embodiment comprises bilateral cores. The cores may be any shape which may provide different levels or compressibility, resistance, support, and airflow. For example, a triangular core may provide graduated resistance. This exemplary embodiment has horizontal oval shaped cores that are approximately 2-4 centimeters tall and approximately 6-12 centimeters wide.

Figure 6:
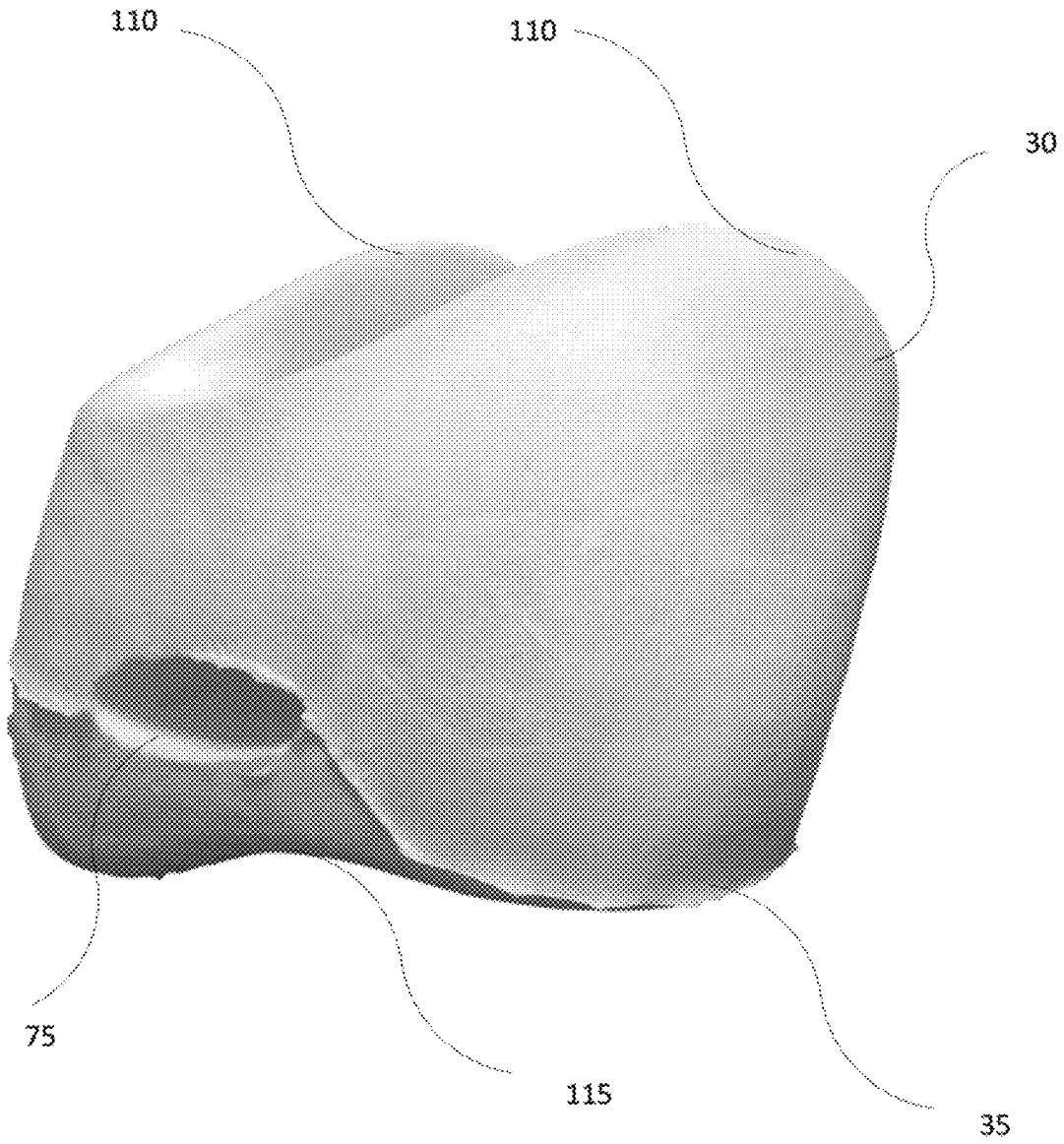
FIG. 6 illustrates a side view of an exemplary embodiment of a pillow.

Referring now to FIG. 6, an alternative exemplary embodiment is shown with a side view. The pillow's bilateral side panels may have a crest with a narrow end at the upper portion and a wide end at the lower portion that are substantially the same height. The side panels may be high profile, contoured, or both. The pillow contours provide an ergonomic fit with a user's body while also reducing bulk. The upper portion at the apex is in contact with a user's neck and chin, and the lower portion at the chin extension is centered with the apex and is in contact with the user's chest. The lower portion of the pillow comprises a contoured parabola on either side of the chin extension. The contoured parabola provides an ergonomic fit while reducing bulk.

Figure 7:
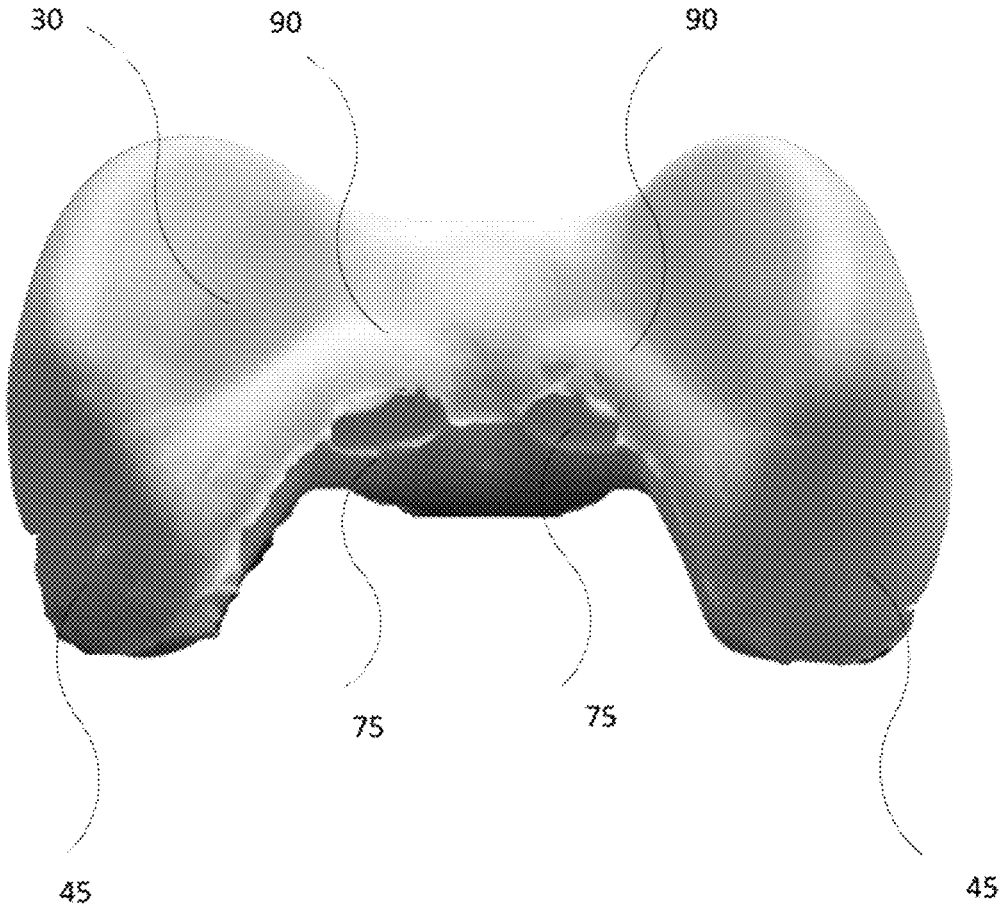
FIG. 7 illustrates a rear view of an exemplary embodiment of a pillow.

Referring now to FIG. 7, an alternative exemplary embodiment is shown with a rear view showing an inside surface. The pillow of claim 1 further comprising a core contour for each core. The core contour may be a raised area extending approximately 1-4 centimeters from an edge of a core defining a hollow core. For example, a core contour may be raised approximately 0.2-5 centimeters from an inside surface. The core contour surrounds each core about the upper portion of the pillow and extends to the rear of the pillow. The core contours aid in providing more support and reduced movement of the pillow when a user adjusts his or her position.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A parabolic travel pillow, comprising:

a pillow body exterior having an upper portion, a lower portion, a rear portion, a front portion, two side panels, an apex, at least one rear portion fastener capable of being adjusted to open and close an open end, a chin extension, a rear extension, one hollow cores having a horizontal oval shape on either side of the apex, and wherein each hollow core on either side of the apex is surrounded by a core contour protruding about 0.2-5 centimeters toward an interior surface of the parabolic travel pillow, and whereby each hollow core is spaced approximately 2.5 centimeters from the other hollow core, and whereby an interior surface of the apex does not have a contour between the hollow cores, and whereby the pillow is used to support a user's head and neck during travel when the user is sitting in an upright or reclined position, and wherein the hollow cores allows air flow to a user and pillow height adjustment between a user's chin and chest.

2. The pillow of claim 1 wherein the side panels are bilateral from the apex and have a crest with a narrow end at the upper portion and a wide end at the lower portion that are substantially the same height.

3. The pillow of claim 1 wherein the side panels are contoured.

4. The pillow of claim 1 wherein the upper portion at the apex is in contact with a user's neck and chin, and the lower portion at the chin extension is centered with the apex and is in contact with the user's chest.

5. The pillow of claim 1 wherein the core contour surrounds each core about the upper portion of the pillow and extends to the rear of the pillow.

6. The pillow of claim 1 wherein the lower portion of the pillow comprises a contoured parabola on either side of the chin extension.

7. A method of providing head and neck support, the method steps comprising:

placing a parabolic travel pillow around a user's neck, upon a user's shoulders, and beneath a user's chin, the pillow comprising:

a pillow body exterior having an upper portion, a lower portion, a rear portion, a front portion, two side panels, an apex, at least one rear portion fastener capable of being adjusted to open and close an open end, a chin extension, a rear extension, one hollow core having a horizontal oval shape on either side of the apex, and wherein each hollow core on either side of the apex is surrounded by a core contour protruding about 0.2-5 centimeters toward an interior surface of the parabolic travel pillow, and whereby each hollow core is spaced approximately 2.5 centimeters from the other hollow core, and whereby an interior surface of the apex does not have a contour between the hollow cores;

attaching the at least one rear fastener behind the user's neck;

adjusting the at least one fastener to fit the pillow firmly in place so that the pillow abuts the user's chin, neck, shoulders, and chest.

8. The method steps of claim 7 further comprising tilting the user's head down and allowing the user's chin to compress the cores.

9. The method steps of claim 8 further comprising placing the core contours against a user's body for support, whereby a protruding surface of the core contours places pressure on sides of the user's neck without placing pressure on the user's trachea.

* * * * *